US005862888A

United States Patent [19]

Iwakiri et al.

[11] Patent Number: 5,862,888

[45] Date of Patent: Jan. 26, 1999

[54] ROPED ELEVATOR WITH VIBRATION DAMPING

[75] Inventors: Atsushi Iwakiri, Yokohama; Nobuyuki Miyahara, Yamato, both of Japan

[73] Assignee: Otis Elevator Company, Farmington, Conn.

[21] Appl. No.: 760,621

[22] Filed: Dec. 4, 1996

[30] Foreign Application Priority Data

Dec. 4, 1995 [JP] Japan ..... 7-314596

[51] Int. Cl.[6] ..... B66B 5/00

[52] U.S. Cl. ..... 187/345; 187/292; 187/391; 187/411

[58] Field of Search ..... 187/345, 346, 187/347, 411, 292, 391, 393, 285

[56] References Cited

U.S. PATENT DOCUMENTS

| | | | |
|---|---|---|---|
| 1,243,339 | 10/1917 | Paquin | 187/345 |
| 4,565,264 | 1/1986 | Kunii | 187/411 |
| 4,830,146 | 5/1989 | Nakamura et al. | 187/253 |
| 5,005,671 | 4/1991 | Aime et al. | 187/411 |
| 5,027,925 | 7/1991 | Kahkipuro | 187/292 |
| 5,289,902 | 3/1994 | Fujita | 187/346 |
| 5,641,041 | 6/1997 | Masuda et al. | 187/347 |
| 5,750,645 | 5/1998 | Fuller et al. | 187/411 |

FOREIGN PATENT DOCUMENTS

| | | | |
|---|---|---|---|
| 593296 | 4/1994 | European Pat. Off. | 187/346 |
| 3709661 | 10/1988 | Germany | 187/292 |
| 5-39181 | 2/1993 | Japan | 187/347 |
| 5-201652 | 8/1993 | Japan | 187/346 |
| 1331787 | 8/1987 | U.S.S.R. | 187/411 |

*Primary Examiner*—Karen M. Young
*Assistant Examiner*—Thuy V. Tran

[57] ABSTRACT

Even if rope (13) and spring (15) oscillate, to suppress these oscillations as much as possible.

An elevator system is equipped with a car (1) that is installed such that it can freely move up and down in a hoistway, a sheave (14) that is installed at the top of the hoistway, a rope (13) for pulling the car that is suspended from this sheave (14), a suspension rod (9) to which the end of this rope (13) is attached, a spring (15) for damping vibrations which is installed between this suspension rod (9) and the car (1), a cylinder device (16) which attenuates the vibrations and has a flow volume control valve (22), a rotary encoder (24) for detecting the position of the car (1) in order to calculate the length of the rope, a load sensor (25) for detecting the load of the car (1) and a control panel (23) which calculates the characteristic vibration frequency f of the rope (13) from the length of the rope, the characteristic vibration frequency $f_N$ of the spring from the car (1) load, and the vibration frequency ratio u ($u=f/f_N$), and is made so as to constrict the flow volume control valve (22) of the above-mentioned cylinder device (16) when u=1.

2 Claims, 5 Drawing Sheets

ROPED ELEVATOR WITH VIBRATION DAMPING

BACKGROUND OF THE INVENTION

1. Technical Field

This invention relates to a rope-type elevator system that is made so as to reduce the vibrations that are generated at the time of taking up the rope with a winding mechanism or the like.

2. Description of The Prior Art

A rope-type elevator system used in the past, for example, is the one shown in FIG. 5. In this same figure, (101) is a car compartment that is installed movable up and down in a hoistway, and a pair of car rope sheaves (104, 105) are attached by means of car frame (103) to the upper section of this car compartment (101). In other words, car rope sheaves (104, 105) are provided in support channel (106), suspension rod (107) is provided in this support channel (106), and this suspension rod (107) is attached to car frame (103) through the medium of spring seats (108) and a number of spiral coil springs (109). A number of ropes (110) are strung in car rope sheaves (104, 105), and these ropes (110) are hung on drive sheave (111) of the winding mechanism.

Vibrations are generated when the winding mechanism is driven and rope (110) is pulled by drive sheave (111). However, if these vibrations are transferred to the car compartment (101), it gives passengers an unpleasant feeling. Thus, it is relieved by springs (109).

In this known rope-type elevator system, the vibrations that were created from drive sheave (111) of the wind-up mechanism were propagated to car (101) through the ropes (110). There was the problem that the isolation frequency ratio u ($u=f/f_N$) of the characteristic vibration frequency f of ropes (110) and the characteristic vibration frequency $f_N$ of the springs (109) became u=1 and resonated, and this resonance imparted an unpleasant sensation to passengers within the car.

The present inventors believe that improvements to reduce this sensation are achievable.

DISCLOSURE OF INVENTION

SUMMARY OF THE INVENTION

It is a principal object of the present invention to provide a rope-type elevator system wherein, even if the rope and the coils resonate, this resonance is made to be suppressed as low as possible.

According to the present invention, an elevator system is equipped with a car that is installed to be freely movable up and down in a hoistway, a sheave installed in the upper part of this hoistway, a rope strung on this sheave for the purpose of pulling the car, a suspension rod attached to the end of this rope, springs installed between this suspension rod and the car for the purpose of cushioning vibrations, a cylinder device which attenuates the vibrations and has a flow control valve, a car position detector which detects the car position in order to calculate the rope length, a load detector for the purpose of detecting the load placed on the car, and a control panel that calculates the characteristic vibration frequency f of the rope from the length of the rope, calculates the characteristic frequency vibration frequency $f_N$ of the springs from the entire weight of the car, next calculates the vibration frequency ratio u ($u=f/f_N$), and is made so as to constrict the flow volume control valve of the above-mention cylinder device when u=1 or u≅1.

Further and still other objects of the present invention will become more readily apparent in light of the following detailed description which taken in conjunction with the following drawing, in which:

DESCRIPTION OF PREFERRED EMBODIMENT AND BEST MODE FOR CARRYING OUT THE INVENTION

FIG. 1 to FIG. 4 show one application example of a rope-type elevator system of this invention.

Figure 1:
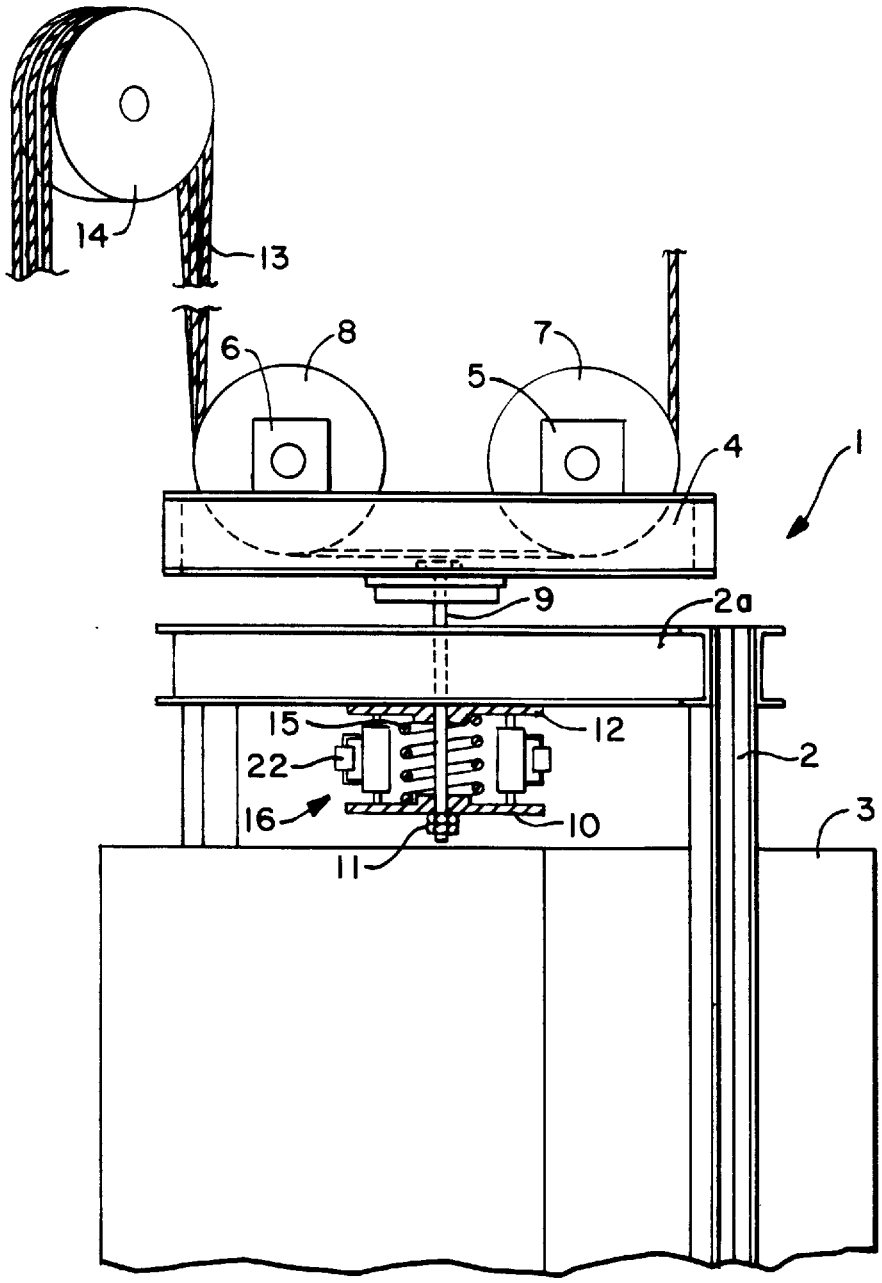
FIG. 1 is a plan view showing one application example of a rope-type elevator system according to this invention.

In FIG. 1, car (1) is installed to be vertically movable in the elevator hoistway, and this car (1) comprises car frame (2), and car compartment (3) that is supported in car frame (2). Support channel (4) is arranged above cross-head channel **(2*a*) of car frame (2), and a pair of sheaves (7, 8) used for the car are attached to this support channel (4) through the medium of support tabs (5, 6)**.

Suspension rod (9) is firmly attached facing downward through the support channel (4), and this suspension rod (9) extends downward through a pair of C-shaped steel beams which form the cross-head channel **(2*a*). Circular bottom spring seat (10) is fastened at the tip of suspension rod (9) by means of tightening double nuts (11). On the other hand, circular upper spring seat (12), through which the suspension rod (9) passes, is attached to the bottom face of cross-head channel (2*a*)**.

A number of ropes (13) is strung on car sheaves (7, 8), and these ropes (13) are strung on the drive sheave (14) of the wind-up mechanism that is installed in the machine room. One end of ropes (13) is fastened to a dead-end hitch beam (not illustrated) of the machine room, and the other end is fastened to a dead-end hitch beam in the same manner as the rope of the car side by means of a counterweight (not illustrated) that is installed for the purpose of counterbalancing the car (1).

Coil spring (15) and a number of cylinder devices (16) are installed between the upper spring seat (12) and the lower spring seat (40). Cylinder devices (16) further attenuate the vibrations that are generated in the drive sheave (14) of the wind-up mechanism that has been cushioned by the coil spring (15).

Figure 2:
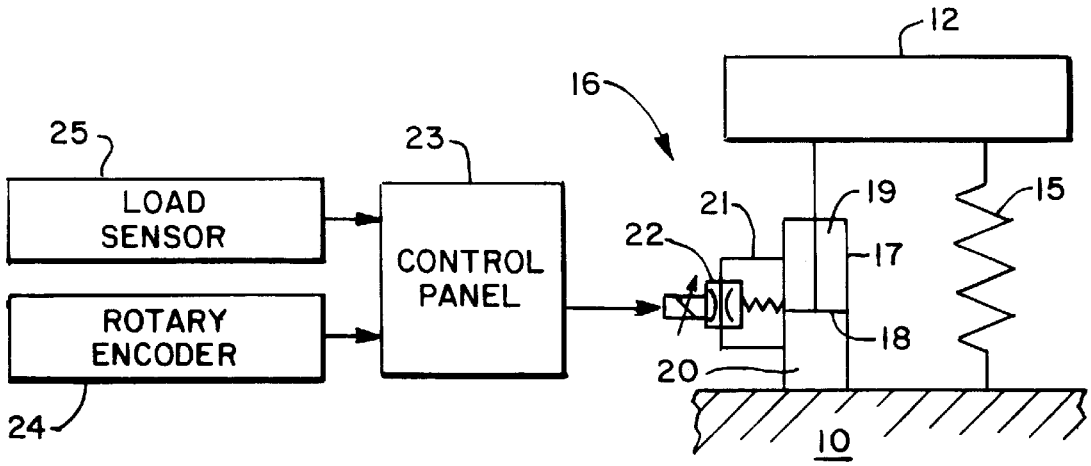
FIG. 2 is a block schematic view of the system of FIG. 1.

Cylinder device (16), as is shown in FIG. 2, comprises the cylinder (17) that is installed between the upper and lower spring seats (12, 10) and piston (18) that is installed inside this cylinder (17), and operating oil is filled into the upper and lower chambers (19, 20) that are formed separated by means of piston (18). Upper and lower chambers (19, 20) are linked by means of tubing (21) that functions as an orifice, and flow volume control valve (22) is installed midway in this tubing (21). Flow volume control valve (22) constricts and releases the operating oil that flows within tubing (21) based on commands from control panel (23). Panel 23 includes, for example, a CPU, memory, buses, I/O ports, all suitably electronically interconnected.

A signal is input into control panel (23) from the rotary encoder (24) that is provided in the speed regulator or the like for the purpose of detecting the position of the car, and a signal is also input into control panel (23) from the load sensor (25) (load detector) that is installed in this floor surface for the purpose of detecting the load of the passengers riding in the car compartment (3).

Figure 3:
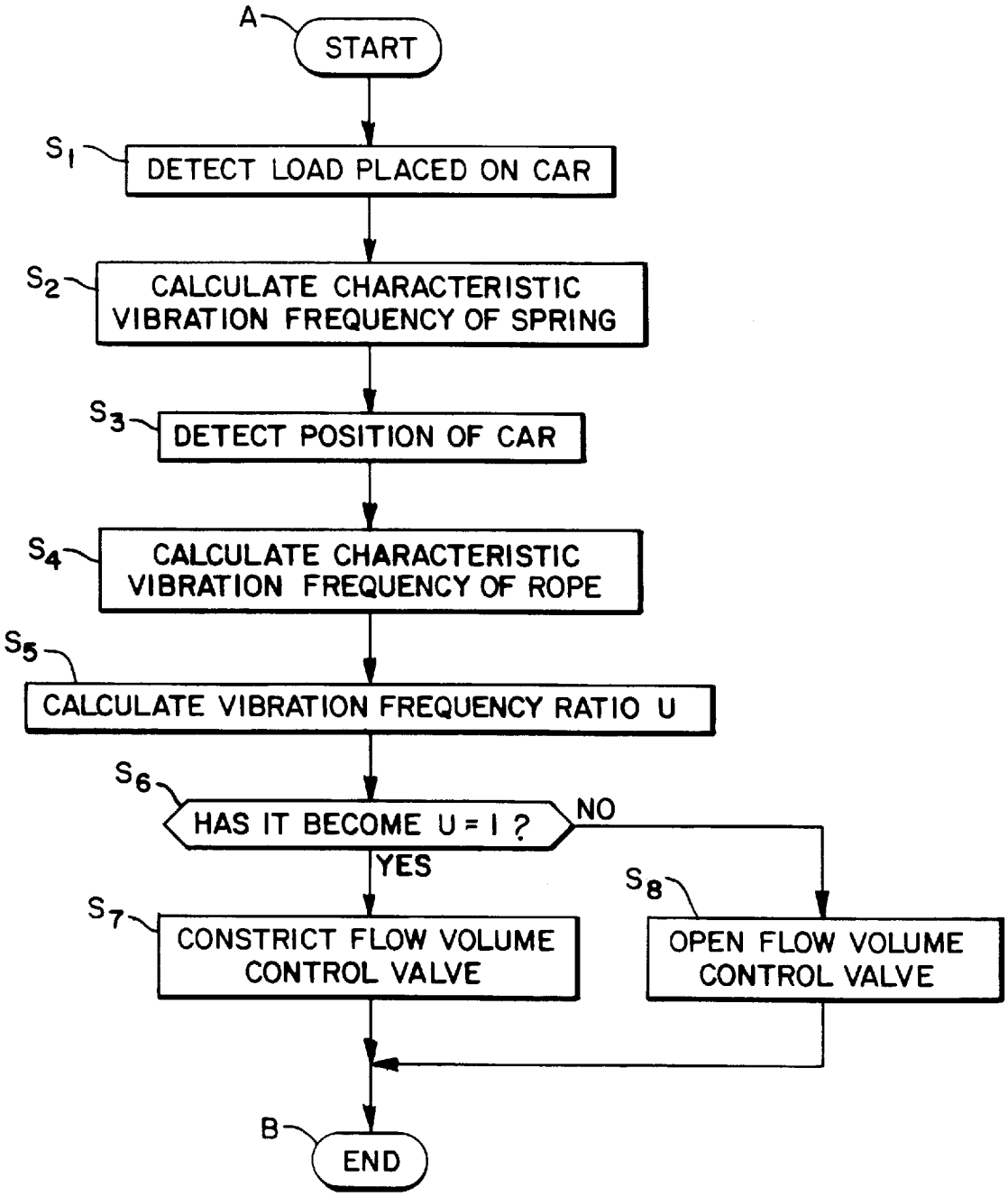
FIG. 3 is a flow chart showing the operation of the cylinder device.

Next, the operation of cylinder devices (16) is explained with reference to the flow chart shown in FIG. 3. The steps of FIG. 3 are suitably coded in software and stored in the memory of the panel 23.

When passengers board the car (1) and it departs in the direction of the target floor, the load of the passengers that have boarded car (1) is detected by means of load sensor (25) (Step $S_1$). When the load of the passengers that have boarded car (1) is detected, the total weight W (kgf) of the car (1) is known. The characteristic vibration frequency $f_N$ (Hz) is (Formula 1)

$$f_N = \frac{1}{2\pi}\sqrt{\frac{K}{W}g}$$

(Here, K: spring constant (Kgf/cm), and g: force of gravity (980 cm/sec$^2$)), the characteristic vibration frequency $f_N$ of spring (15) is calculated in control panel (23) (Step $S_2$).

Next, the position of car (1) is detected by means of rotary encoder (24) (Step $S_3$). When the position of car (1) is detected, the length of the rope (13) between the car sheave (8) and the drive sheave (14) of the wind-up mechanism is known. The characteristic vibration frequency f (Hz) of the above-mentioned intervening rope (13) is (Formula 2)

$$f = \frac{n}{2L}\sqrt{\frac{S}{P}}$$

Here, L: rope length (m), S: rope (13) tensile strength (N), P: mass per unit length of rope (13) (kg/m), and n: degree of vibration. Here, the tensile strength S (N) of rope (13) is known from the drive force of the wind-up mechanism. Thus, the characteristic vibration frequency f of the above-mentioned interval of rope (13) is calculated in control panel (23) (Step $S_4$).

Next, the vibration frequency ratio $u=f/f_N$ is calculated from the calculated characteristic vibration frequency $f_N$ of the spring (15) and the characteristic vibration frequency f of rope (13) (Step $S_5$).

Figure 4:
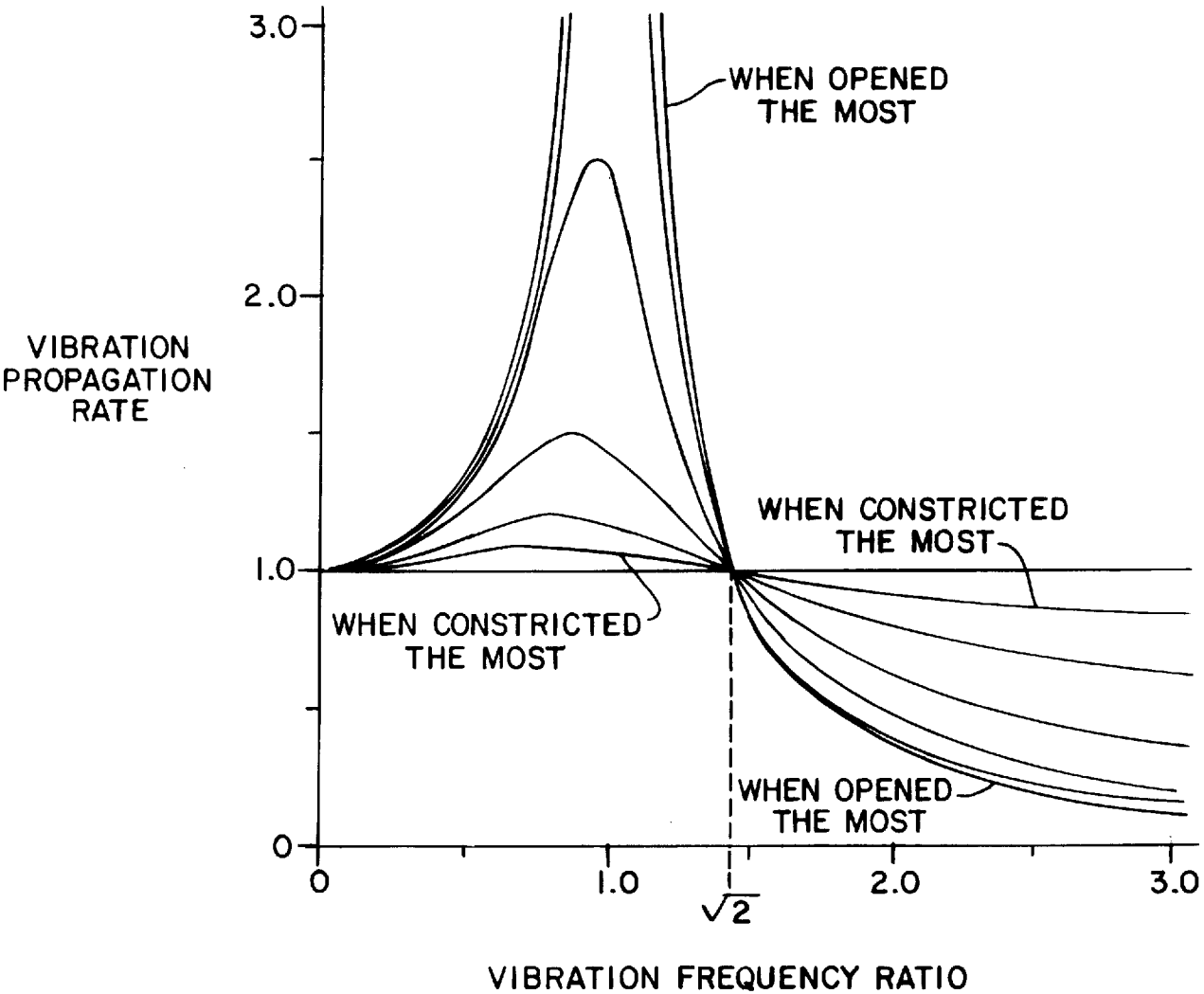
FIG. 4 is a chart showing the relationship between the vibration frequency ratio and the vibration propagation rate.
Figure 5:
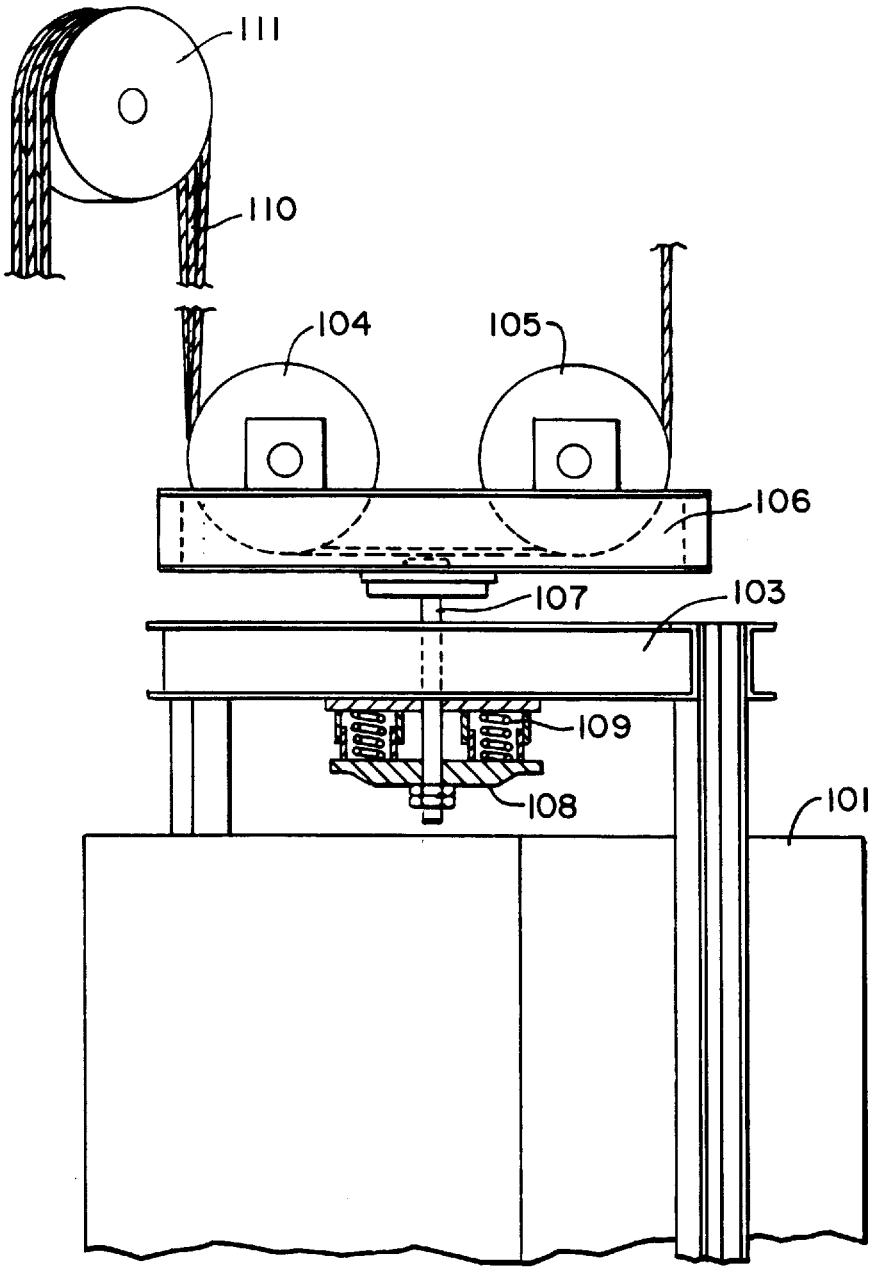
FIG. 5 PRIOR ART
FIG. 5 is a plan view of a known rope-type elevator system.

Here, the changes in the relationship of the vibration frequency ratio u and the vibration propagation rate due to the flow volume control valve (22) of the cylinder device (16) are shown in FIG. 4. When the flow volume control valve (22) of cylinder device (16) is opened the widest, the crest of the vibration propagation rate (resonance point of rope (13) and spring (15)) reaches a maximum where the vibration frequency ratio is in the vicinity of "1," and when the vibration frequency ratio exceeds "$\sqrt{2}$," the vibration propagation rate draws a steep curve and rapidly lowers. With the vibration frequency ratio in the vicinity of "1" due to constricting the flow volume control valve (22), the crest of the vibration propagation rate gradually becomes lower, and when the vibration ratio exceeds "$\sqrt{2}$," the vibration transfer rate does not become very low.

Therefore, when the vibration frequency ratio is "1," if the flow volume control valve (22) is constricted, the vibration propagation rate crest becomes low. On the other hand, when the vibration frequency ratio is not "1," the open condition of the flow volume control valve (22) is when the vibration propagation rate becomes low.

Thus, a decision is made as to whether the vibration frequency ratio u has become u=1 (Step $S_6$). When the vibration frequency ratio u becomes u=1, the flow volume control valve (22) has become constricted to the maximum (Step $S_7$). In this way, the peak of the vibration propagation rate is lowered, and the resonance of the rope (13) and spring (15) can be kept low. On the other hand, when the vibration frequency ratio u is $u \neq 1$, the flow volume control valve (22) opens (Step $S_8$). In this way, the vibration propagation rate can be lowered.

Therefore, the vibrations that are propagated from the drive sheave (14) of the wind-up mechanism to the car (1) through the medium of rope (13) can be suppressed to as low as possible even though rope (13) and spring (15) are resonant, and it can be suppressed to an even lower level when they are not resonant.

As was explained above, according to this invention, the characteristic vibration frequency f of the rope is calculated from the length of the rope; also, the characteristic vibration frequency $f_N$ of the spring is calculated from the total weight of the car; next, the vibration frequency ratio u ($u=f/f_N$) is calculated, and since the flow volume control valve of the above-mentioned cylinder device is made so as to constrict when u=1 or $u \cong 1$, the vibrations that are propagated from the sheave to the car through the medium of the rope can be kept as low as possible even if the rope and spring are resonant, can be suppressed to another level lower when not resonant, and there is no imparting of an unpleasant sensation to the passengers in the car. Thus, for example, valve 22 is closed when $1<u<\sqrt{2}$ and open when $u>\sqrt{2}$.

While it has been shown and described what is presently considered preferred embodiments of the present invention, it will be readily understood to those skilled in the art that various changes and modifications may be made therein without departing from the spirit and scope of the present invention which shall be defined by the appended claims.

What is claimed is:

1. A rope-type elevator system characterized in that the system comprises a car that is installed such that the car can freely move up and down in a hoistway, a sheave that is installed at the top of the hoistway, a rope for pulling the car that is suspended from the sheave, the sheave is attached to a support channel a suspension rod is attached to the support channel, a spring for dampening vibrations which is installed between the suspension rod and the car, a cylinder device for attenuating the vibrations and which has a flow volume control valve, said cylinder device being installed between the suspension rod and the car a position detector for detecting the position of the car, and a control panel for calculating the characteristic vibration frequency f of the rope from the length of the rope, the characteristic vibration frequency $f_N$ of the spring from the car load, and the next vibration frequency ratio u ($u=f/f_N$), the panel being so as to constrict the flow volume control valve of the cylinder device when u=1.

2. A rope-type elevator system characterized in that the system comprises a car that is installed such that the car can freely move up and down in a hoistway, a sheave that is installed at the top of the hoistway, a rope for pulling the car that is suspended from the sheave, the sheave is attached to a support channel, a suspension rod is attached to a support channel, a spring for dampening vibrations which is installed between the suspension rod and the car, a cylinder device for attenuating the vibrations and which has a flow volume control valve, said cylinder device being installed between the suspension rod and the car a position detector for detecting the position of the car, and a control panel for calculating the characteristic vibration frequency f of the rope from the length of the rope, the characteristic vibration frequency $f_N$ of the spring from the car load, and the next vibration frequency ratio u ($u=f/f_N$), the panel being so as to constrict the flow volume control valve of the above-mentioned cylinder device when $u \cong 1$.

* * * * *